US005770007A

United States Patent [19]

Czech et al.

[11] Patent Number: 5,770,007

[45] Date of Patent: Jun. 23, 1998

[54] DEVICE FOR DISPENSING TRANSFER MATERIAL

[75] Inventors: Manuel Czech, Neutraubling; Hermann Runge, Kneiting/Pettendorf, both of Germany

[73] Assignee: Czewo Plast Kunststoffechnik GmbH, Neutraubling, Germany

[21] Appl. No.: 432,977

[22] Filed: May 2, 1995

[30] Foreign Application Priority Data

May 2, 1994 [DE] Germany ..... 94 07 305 U

[51] Int. Cl.[6] ..... B44C 7/00

[52] U.S. Cl. ..... 156/540; 156/577; 156/579; 156/584

[58] Field of Search ..... 156/540, 577, 156/579, 584

[56] References Cited

U.S. PATENT DOCUMENTS

| | | | |
|---|---|---|---|
| 4,270,968 | 6/1981 | Dudzik et al. | 156/361 |
| 4,574,030 | 3/1986 | Pilcher | 156/522 |
| 4,849,064 | 7/1989 | Manusch et al. | 156/577 |
| 4,891,090 | 1/1990 | Lorincz et al. | 156/577 |
| 4,985,110 | 1/1991 | Becker | 156/577 X |

FOREIGN PATENT DOCUMENTS

| | | | |
|---|---|---|---|
| 0 362 697 A1 | 4/1990 | European Pat. Off. | B65H 35/07 |
| 0 427 870 A1 | 5/1991 | European Pat. Off. | B65H 35/07 |
| 42 20 712 A1 | 1/1994 | Germany | B05C 17/02 |

*Primary Examiner*—Timothy McMahon
*Assistant Examiner*—E. Leigh McKane
*Attorney, Agent, or Firm*—Seed and Berry LLP

[57] ABSTRACT

The present invention refers to a device for dispensing onto a surface a transfer material provided on a carrier strip, and it comprises a supply reel rotatably accommodated in a housing and which is used for storing thereon the carrier strip together with the transfer material, and a take-up reel which is also rotatably accommodated in said housing such that it is radially displaced relative to said supply reel and which is used for receiving thereon the carrier strip from which the transfer material has been removed at least partially. The two reels have provided between them a rotary drive transmitting mechanism and a clutch means for providing a driving transmission ratio which is adapted to the respective unwinding/winding-up condition of the reels. The clutch means further comprises a friction wheel element which yields in the radial direction and which is arranged coaxially with an axis of the pair of reels, the friction wheel element abutting via a peripheral surface thereof on a peripheral surface section of a counter-wheel element so as to provide a friction force-transmitting area of contact. The device further includes a manually operable tensioning wheel and a return stop device, provided between two shaft sections of the take-up reel. The return stop device comprising an engagement section which is adapted,to be moved essentially parallel to the axis of the respective reel.

26 Claims, 2 Drawing Sheets

DEVICE FOR DISPENSING TRANSFER MATERIAL

BACKGROUND OF THE INVENTION

The present invention refers to a device for dispensing onto a surface a transfer material, in particular an adhesive transfer material, provided on a carrier strip, comprising a supply reel which is rotatably accommodated in a housing and which is used for storing thereon the carrier strip together with the transfer material, a take-up reel which is also rotatably accommodated in said housing such that it is radially displaced relative to said supply reel and which is used for receiving thereon the carrier strip from which the transfer material has been removed at least partially, a rotary drive transmitting mechanism used for rotatively driving the take-up reel when the supply reel rotates in an unwinding movement and including a clutch means for providing a driving transmission ratio of said rotary drive transmitting mechanism which is adapted to the respective unwinding/winding-up condition of the reels.

U.S. Pat. No. 3,969,181 discloses a device for dispensing an adhesive film, said device comprising a pair of reels accommodated in the interior of a housing and consisting of a supply reel and of a take-up reel. The take-up reel is coupled with the supply reel via a brush element attached to a radial lateral surface of a driving wheel. The device is intended to be used for industrial purposes and its structural design is consequently rather complicated.

Also German-Offenlegungsschrift 36 38 722 discloses a device for dispensing an adhesive film. This device comprises a housing and a pair of reels which are rotatably arranged within said housing and which are drivingly connected via a gear transmission mechanism and a clutch with resiliently deflectable spring claws. In addition to the fact that the components of said device are comparatively complicated to mould and comparatively difficult to produce, taking into account that the device in question is a mass product, said device also turned out to be disadvantageous with regard to its unwinding characteristics, since, on the one hand, there are variations in the tension of a carrier strip unwound from one of the reels and, on the other hand, the unwinding operation causes an unpleasant noise.

SUMMARY OF THE INVENTION

It is the object of the present invention to provide a device of the type mentioned at the beginning, which, taking into account aspects of moulding and assembly techniques, can be produced simply and at a moderate price, which has harmonic unwinding characteristics, and which is particularly easy to operate.

According to the present invention, this object is achieved by the features that the clutch means comprises a friction wheel element which yields in the radial direction and which is arranged coaxially with an axis of the pair of reels, said friction wheel element abutting via a peripheral surface thereof on a peripheral surface section of a counterwheel element so as to provide a friction force-transmitting area of contact.

By means of the above features, a device for dispensing a transfer material can be provided in an advantageous manner, said device having a particularly simple structural design and providing a uniform carrier strip tension during a tape unwinding process. In view of the fact that it is not necessary to produce engaging structures on the individual reels, such structures being difficult to manufacture from the point of view of production engineering, and in view of the fact that it is not necessary to provide any intermediate gears or bearings for such gears, a mould required for moulding the plastic components can be produced at a much lower price than has hitherto been the case. By means of the low-priced, but extremely robust and durable mechanism, it is, in a surprisingly simple manner, possible to observe the optimum carrier strip tension within very close tolerance ranges.

A particularly advantageous embodiment of the device according to the present invention is obtained on the basis of the feature that the friction wheel element is arranged coaxially with the take-up reel. This provides the advantage that the friction wheel element can be constructed as a comparatively small component, the production of which will not consume a large amount of material. Also with regard to the lateral stability of the friction wheel element, a comparatively compact structural design of this component turned out to be particularly advantageous.

In accordance with a particularly advantageous embodiment, the counterwheel element is arranged coaxially with the supply reel. It is thus possible to support also the counterwheel element on a trunnion provided for supporting the supply reel. In this case, the counterwheel element is formed integrally with the supply reel in an advantageous manner.

Yet another advantage of the present invention is obtained by the fact that the the external diameter of the friction wheel corresponds essentially to the diameter of a tape core provided for receiving thereon the carrier strip. When the diameter of the counterwheel element is dimensioned such that it is larger than the external diameter of a carrier strip roll which has not yet been used, a particularly advantageous transmission ratio will automatically be obtained. This transmission ratio is always of such a nature that the take-up reel endeavours to wind up a longer tape section than the tape section unwound from the supply roll. In the case of the above-mentioned dimensioning of the external diameter of the friction wheel, the tension force acting in the carrier strip essentially corresponds, in a particularly simple manner, to the friction force transmitted between the friction wheel element and the counter-wheel element. Hence, the tension force can be predetermined in an extremely precise way and it is independent of the elasticity of the other transmission components (this elasticity depends on the type of plastic material used as well as on moulding process parameters, in particular on the cooling and on the length of the injection period).

A particularly advantageous embodiment of the device according to the present invention is also accomplished by the features that the external radius of the friction wheel is smaller than the radius of curvature of the surface section of the counter-wheel element abutting on the friction wheel. In this connection, it is also possible to couple the friction wheel to a hollow cylindrical interior surface of said counterwheel element, whereby a side-by-side arrangement of the supply reel and of the take-up reel is made possible.

A particularly advantageous embodiment of the device according to the present invention is accomplished by the feature that the friction wheel element is a rectangular torus, since such a friction wheel element can be produced in a particularly simple and economy-priced manner. In accordance with an advantageous embodiment, the rectangular torus has, when seen in the axial direction, a cross-sectional width which is smaller than a radially extending cross-sectional height. This cross-sectional height corresponds in an advantageous manner essentially to half the internal diameter of the friction wheel element.

A particularly advantageous embodiment of the device according to the present invention is accomplished by the feature that, undergoing elastic expansion, the friction wheel element is attached to a shaft section, in particular to a shaft section of the take-up reel. This way of attaching the friction wheel element guarantees a particularly reliable torque transmission to the take-up reel. An alternative possibility is, however, that the friction wheel element has an internal diameter which is larger than a shaft section provided for receiving thereon said friction wheel element. If this type of structural design of the friction wheel is used, a transmission ratio between the two reels will be obtained which deviates from that obtained by means of the embodiment including a friction wheel element which is fixedly attached to the take-up reel.

In accordance with a particularly advantageous embodiment, the friction wheel element is an O-ring. This type of friction wheel element can be produced in a particularly simple an economy-priced manner, or it is available as a standard component. Yet another advantage of the present invention is attained by the fact that the friction wheel element consists of an elastic material having a high coefficient of surface friction, especially rubber. It is also possible to produce the friction wheel element from a foamed material, whereby the inherent elasticity of said friction wheel element can advantageously be influenced on the one hand and the amount of material required for producing the friction wheel element can be reduced on the other.

Yet another particularly advantageous embodiment of the device according to the present invention is accomplished by the features that the take-up reel comprises a shaft section for receiving thereon the friction wheel element and a shaft section for receiving thereon a tape core. In this connection, a manually operable tensioning wheel is provided between said shaft sections in accordance with an advantageous embodiment. A take-up reel having this structural design is particularly simple to manufacture from the point of view of production engineering and it permits particularly simple refilling of the device.

A particularly advantageous embodiment of the supply reel of the device according to the present invention is accomplished by the feature that the supply reel includes the counterwheel element and a shaft section for receiving thereon a tape core. Such a supply reel can be produced in a manner which is approximately as advantageous as the production of the above-mentioned take-up reel.

An embodiment of the device according to the present invention which is particularly well-designed from the aesthetic point of view is obtained by the feature that an area of contact between the friction wheel element and the counterwheel element is covered by the tensioning wheel. The mechanism according to the present invention thus presents a compact outward appearance. A completely uncovered radial lateral surface of the tensioning wheel can be marked with large-area symbols indicating the direction of rotation (arrows).

A particularly advantageous embodiment of the device according to the present invention is accomplished by the feature that the shaft of the take-up reel is arranged in a housing area located adjacent an applicator device. This permits a particularly small structural size of the device according to the present invention as well as a particularly advantageous carrier strip path without the use of any deflection pulleys. The distance between the shaft of the supply reel and the applicator device is larger than the distance between the shaft of the take-up reel and said applicator device in accordance with an advantageous embodiment. When the reels are arranged relative to each other in this way, they can be accommodated in a drop-shaped housing in a particularly space-saving manner.

Yet another particularly advantageous embodiment of the device according to the present invention is attained by the fact that the carrier strip is unwound in an area located between said supply reel and said take-up reel, and that the carrier strip is supplied to the take-up reel in an area which is located diametrically opposite an unwinding area of the supply reel relative to the shaft of the take-up reel. In accordance with an advantageous embodiment, the counterwheel element is dimensioned such that its diameter is larger than the tape core diameter of the supply reel. For providing a lateral surface which is suitable to guide the carrier strip having attached thereto the transfer material, the counterwheel element has, in accordance with an advantageous embodiment, a diameter which is larger than an initial external diameter of the supply tape roll.

For providing improved traction between the friction wheel element and the counterwheel element, the counterwheel element can have a profile. Especially in connection with a friction wheel element consisting of an O-ring, it is also possible to construct an outer peripheral surface of the counterwheel element, which comes into contact with the friction wheel element, as a convex or concave surface. In cases in which a concave peripheral surface is provided, the two wheels will be stabilized relative to one another in a particularly advantageous manner.

A particularly advantageous embodiment of the device according to the present invention is accomplished by the features that a return stop device is provided, which is used for blocking the rotational movement of the take-up reel in a direction opposite to the direction of the rotational take-up movement, said return stop device comprising an engagement section which is provided in the housing and which is adapted to be brought into engagement with a countersection adapted to be moved relative thereto. An embodiment of the device which is particularly advantageous in accordance with the present invention is obtained by the features that the countersection and the take-up reel are adapted to be rotated about the same axis, and that the engagement section and the countersection are adapted to be moved relative to one another essentially parallel to the axis of the take-up reel so as to move away from a position of mutual engagement. In particular from the point of view of production engineering, this type of return stop device can be manufactured in a particularly advantageous manner, and, in addition, it provides the device according to the present invention with a particularly pleasant unwinding character in combination with a noise which is typical of this special device.

A particularly advantageous embodiment of the countersection is accomplished by the feature that said countersection includes a sawtooth section formed on an end face of a shaft section of the take-up reel which faces a lateral surface of the housing. In accordance with a particularly advantageous embodiment, it is possible to arrange the friction wheel element on this shaft section provided with said sawtooth profile. In this return stop device according to the present invention, the take-up reel is adapted to be axially moved relative to said housing in an advantageous manner. When this type of embodiment is used, the inherent elasticity of the housing of the device can be utilized for generating, in an advantageous manner, a pressing force which is required for resetting the take-up reel.

BRIEF DESCRIPTION OF THE DRAWINGS

Additional features of the present invention are disclosed by the description of an embodiment following hereinbelow in connection with the drawing, in which.

DETAILED DESCRIPTION OF THE INVENTION

Figure 1:
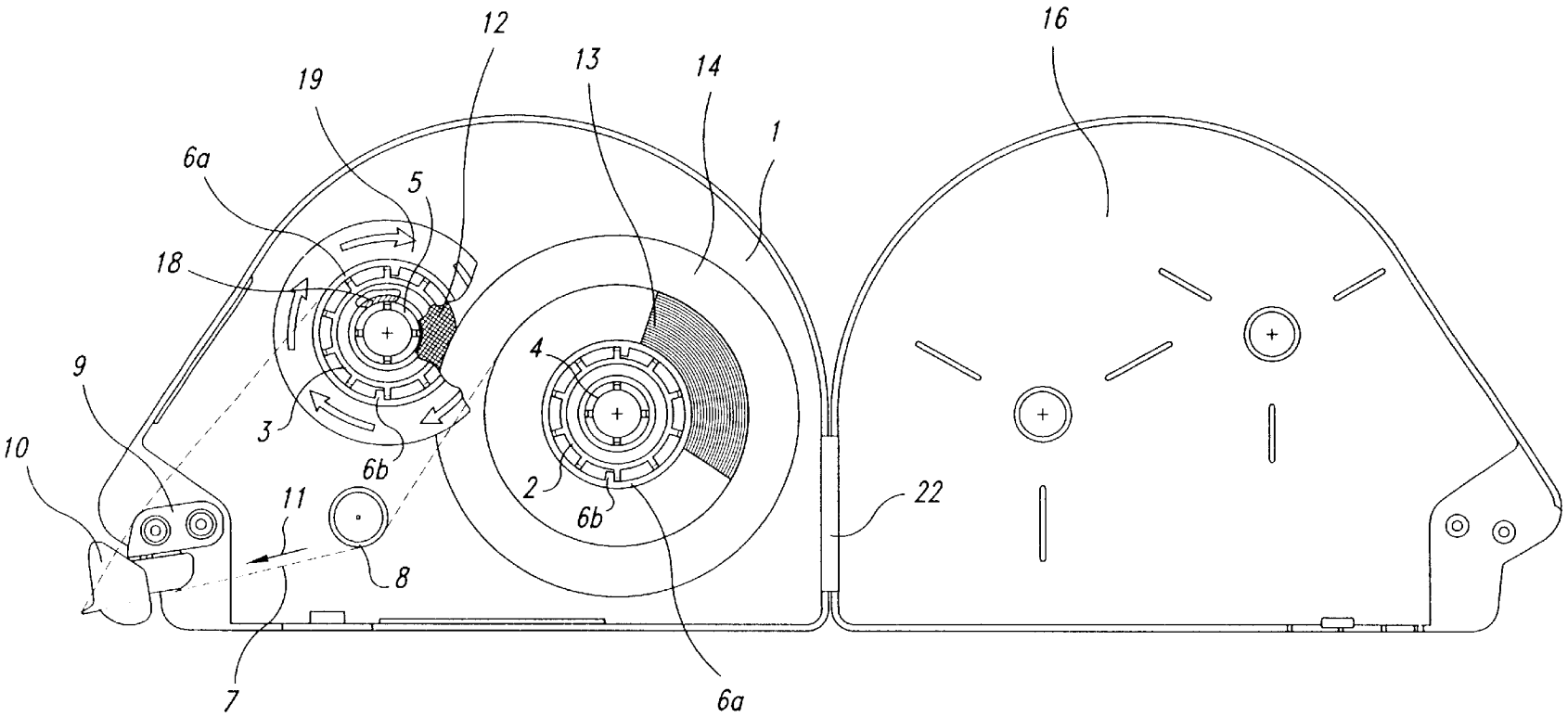
FIG. 1 shows a view of a device according to the present invention in an open condition for showing the shape of the individual components of the device and the way in which said components are associated with one another in the interior of the housing.

According to FIG. 1, a supply reel 2 and a take-up reel 3 are rotatably supported on journals 4 and 5 in radially spaced relationship with each other in the interior of a housing 1 of the device according to the present invention. The supply reel 2 is used for storing thereon via a tape core 6*a* of a carrier strip 7 in the form of a roll, said carrier strip having provided thereon a transfer material. The carrier strip 7 is guided via a deflection means a to a lip 10 which is articulated on a ball joint 9. Subsequent to said lip, when seen in the direction of transport 11, the carrier strip 7 is guided to a tape core 6*a* arranged on the take-up reel 3. The tape core 6*a* is drivingly connected to the take-up reel 3 via a driving projection 6*b*. Under the influence of the tension in the carrier strip 7, said driving projection 6*b* is held in contact with a driving section formed on the take-up reel 3. The driving projection 6*b* is adapted to be inserted into a plurality of driving sections formed on the take-up reel 3. On the basis of the structural design of the tap; core 6*a*, which is shown in FIG. 1, and of the shaft section forming part of the take-up reel 3 and provided for receiving thereon the tape core 6*a*, said tape core 6*a* can be attached to the take-up reel 3 in a particularly simple manner. The same tape core geometry is also used on the side of the supply reel 2. In this case, too, a tape core 6*a* is connected via a driving projection 6*b* to a shaft section of the supply reel 2 with a certain amount of play in the circumferential direction. In view of the layer thickness of the transfer material, the carrier strip 7, which has provided thereon said transfer material, is first stored on a tape roll 13 having a comparatively large diameter. When the transfer material has been removed, the corresponding carrier strip length is taken up on a roll having, in the final analysis, a smaller diameter. In view of the fact that, when the transfer material is being consumed, the diameter of the tape roll 13, which serves to store the carrier strip 7 together with the transfer material, decreases more rapidly than the diameter of a take-up roll formed on the take-up reel 3 increases, it is possible to arrange the two reels 2 and 3 so close to each other that the respective space remaining between the two rolls will only be small.

The take-up reel 3 is driven via a friction wheel element 12, which abuts on a peripheral surface section of a counterwheel element 14. The counterwheel element 14 is adapted to be driven via the tape core 6*a* and the driving projection 6*b* thereof by unwinding the carrier strip 7 from the tape roll 13. By means of the counterwheel element 14 and the friction wheel element 12, the necessary minimum transmission ratio is generated between the supply reel and the take-up reel. The theoretical transmission ratio defined by the diameter combination of counterwheel element 14 and friction wheel element 12 automatically adapts itself, due to slippage between said friction wheel element 12 and said counterwheel element 14, to the transmission ratio which is actually required and which exclusively depends on the outer diameters of the tape rolls which are being formed and consumed, respectively. In the case of the embodiment shown in FIG. 1, the tension force acting in the carrier strip 7 is slightly less than a friction force transmitted between the friction wheel element 12 and the counterwheel element 14.

In order to prevent the take-up reel from rotating in a direction rection opposite to the direction of the rotational take-up movement, a return stop device is provided, which will be described in detail hereinbelow in connection with FIG. 3. By means of the return stop device 16 and the friction wheel element 12 as well as the counterwheel element 14, also the supply reel 2 is secured against unintentional rotation due to the friction force between the friction wheel element 12 and the counterwheel element 14. Due to fine indentations which the return stop device has in connection with the friction wheel element 12 and the complementary counterwheel element 14, the carrier strip is unwound from the supply roll in a particularly uniform manner.

Figure 2:
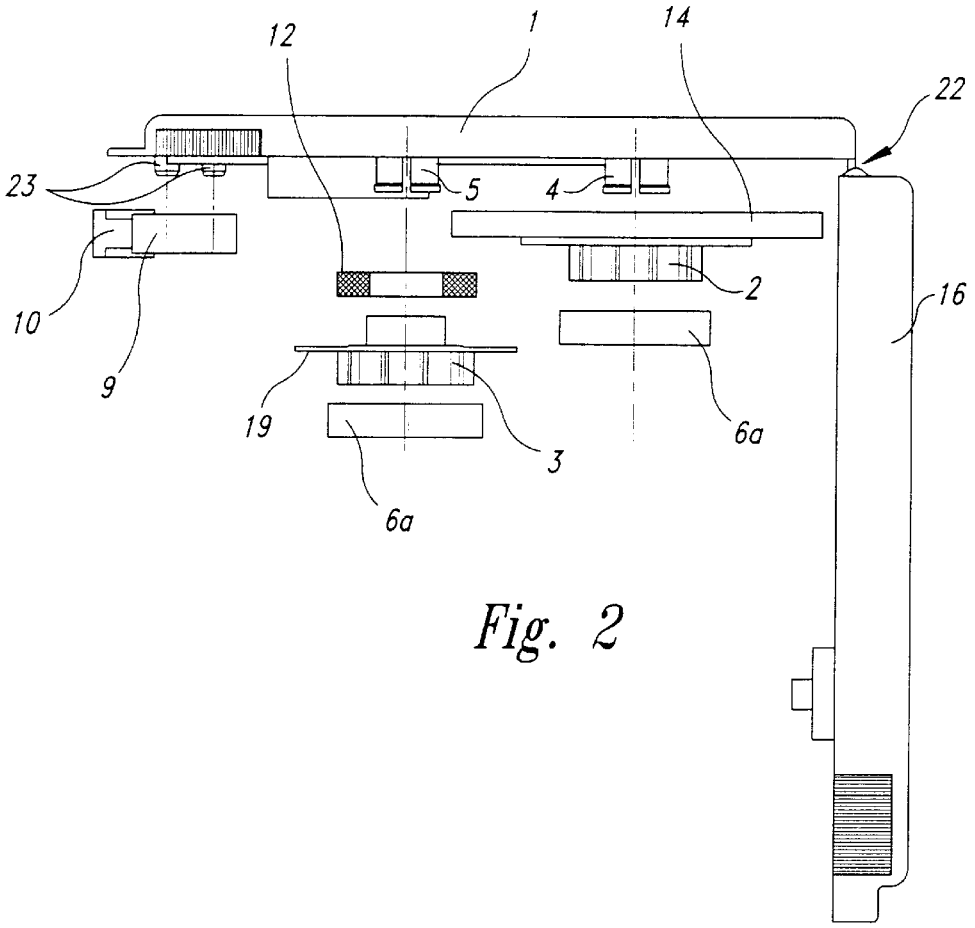
FIG. 2 shows an exploded view of the same device in which a housing component has been pivoted to a 90° open position.

FIG. 2 shows the device in a condition in which the cover 16 has been pivoted by 90° about an articulation means 22 to an open position. The ball joint 9 as well as the supply reel 2 and the take-up reel 3 are attached to pin sections protruding at right angles from the housing wall. For holding the ball joint 9 in the housing 1, a pair of hollow cylindrical pins 23 is provided. These hollow cylindrical pins 23 project only partially into the ball joint 9 in adequate holes provided in pairs. The remaining portions of the holes provided in the ball joint 9 are, in the closed condition of the housing 1, engaged by a pair of hollow cylindrical portions which are formed on the cover 16 and which project into said remaining portions of the holes. The journals 4 and 5 used for supporting the supply reel 2 and the take-up reel 3 comprise four spring claw elements by means of which the reels attached to said journals are lockingly secured in the axial direction. The journals 4 and 5 define cylindrical internal spaces, which are adapted to have inserted therein a pair of ring pivot sections, which are attached to the cover 16, whereby the spring deflection of the spring claw elements of said journals 4 and 5 will be restricted.

Figure 3:
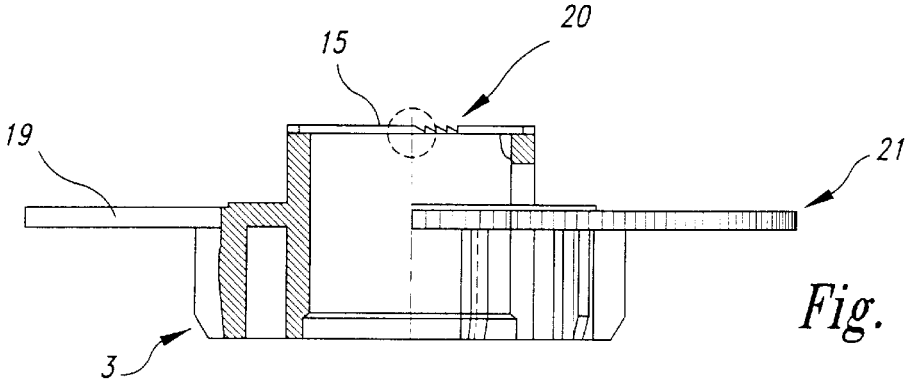
FIG. 3 shows an axial sectional view of the take-up reel.
Figure 4:
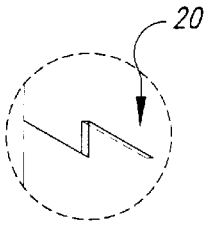
FIG. 4 shows a detail of the take-up reel of FIG. 3.

According to FIG. 3, the take-up reel 3 comprises a tensioning wheel 19 as well as a toothed section which has a sawtooth geometry and which is formed on the end face of a shaft section of the take-up reel. This toothed section is formed without any undercut portions with respect to the axial direction of the supply reel. The toothed section 20 is provided for engagement with a corresponding, annulary extending toothed section 18 (cf. also FIG. 1), which is formed on the housing. A spring force, which is necessary for acting on said toothed sections, is applied preferably by the outer surfaces of the housing and/or by the inherent elasticity of the supply reel as well as of the journal 5.

In accordance with a special aspect of the present invention, a cap element is provided, which is adapted to be attached to the device in such a way that it surrounds the applicator lip. For this purpose, the housing is constructed in an advantageous manner in such a way that it tapers in steps and the cap element is adapted to be attached to at least part of the tapering section. The cap element is, in an advantageous manner, held in position by means of a frictional transmission of forces. The surface used as holding surface preferably consists of the respective housing sections extending at right angles to the axes of the reels.

According to a further aspect of the present invention, a snap connection means is provided between said cap element and the housing. The hinge, which is provided between the housing halves in an advantageous manner, is formed on the housing side located opposite the lip. A closure means effective between the housing halves preferably comprises a connection means which is adapted to be brought to a release position by applying pressure to the exterior of the housing.

In order to permit particularly easy handling of the device, the tensioning wheel 19 is knurled 21. The shaft section of the take-up reel 3 is chamfered in an area facing away from the tensioning wheel 19, said chamfer permitting the tape core 6*a* to be attached in a particularly simple wanner, if necessary with minor elastic expansion of said tape core. In view of the fact that the chamfer is provided on the shaft section which is intended to be used for receiving thereon the tape core 6*a*, it will also be possible to compensate for major tolerance deviations resulting from the manufacturing process. Elements 2, 6*a* and 14 as well as elements 3*a* and 6*a* can be formed integrally in an advantageous manner.

The device described hereinbefore can be used, by way of example, ample in the way which will be described in detail hereinbelow. For clearly explaining the use of the device, it will be assumed in the following that the device has been assembled such that it is in working order, but is not yet equipped with a carrier strip having provided thereon the transfer material. For equipping the device with a carrier strip, the housing of the device is opened. For this purpose, the cover of the housing is pivoted with the aid of a hinge to an open position when a closure means on said housing has been released. Following this, a tape roll consisting of the carrier strip and the transfer material is attached to the supply reel. Subsequently, an additional tape core connected to a front end section of the carrier strip is attached to the take-up reel. A carrier strip section remaining between the supply reel and the take-up reel is guided over a deflection means and the applicator device. Following this, the carrier strip is tensioned by manually operating the tensioning wheel. The device according to the present invention provides the advantageous possibility of arresting the counterwheel element so that it is possible to wind an only very small section of the carrier strip onto the take-up reel for the purpose of tensioning the carrier strip. When the carrier strip has been tensioned by the tensioning wheel, the cover of the housing will be pivoted to the closed position where it will be lockingly engaged with the housing by applying light pressure to the sides of said housing. The device is now ready for use. For applying the transfer material to a surface, an applicator lip projecting beyond the front end section of the housing is pressed against a support and is simultaneously drawn in a direction parallel to the surface. Due to a force transmitted between said support and the tape portion pressed onto said support, the carrier strip having provided thereon the transfer material is unwound from the supply reel by means of the unwinding movement and is then continuously guided over the applicator lip. The transfer material is separated from the carrier strip at the applicator lip and remains on the support. The carrier strip, which has no longer attached thereto the transfer material, is wound onto the tape core arranged on the take-up reel. In the course of this process, the take-up reel is always driven via the friction wheel element in such a way that a uniform tension will be maintained in the carrier strip. When the carrier strip has been fully unwound from the supply reel, the supply of transfer material is exhausted, and a new roll consisting of carrier strip and transfer material must be inserted in the device. For this purpose, the housing is opened in the manner described hereinbefore and the tape core attached to the supply reel is removed therefrom. The carrier strip roll, which has now formed on the take-up reel, is removed from said take-up reel together with its tape core in the same way. When this has been done, a new reel and an appropriate tape core are inserted into the device in the manner which has been described hereinbefore and the housing is closed again.

The present invention is not limited to the embodiment described hereinbefore; it is, for example, also possible to connect the carrier strip to the take-up reel without using any tape core. It is also possible to use the above described return stop device without the mechanism according to the present invention which is used for transmitting the rotational movement and which has been described hereinbefore, or to use, instead of this particularly advantageous mechanism, e.g. an engagement device acting on the tensioning wheel.

All the features, including the structural details, which are disclosed by the description and the drawings can also be essential to the present invention in any combination.

We claim:

1. A device for dispensing onto a surface a transfer material, provided on a carrier strip, comprising a supply reel which is rotatably accommodated in a housing and which is used for storing thereon a carrier strip together with a transfer material, a take-up reel which is also rotatably accommodated in the housing such that it is radially displaced relative to the supply reel and which is used for receiving thereon the carrier strip from which the transfer material has been removed at least partially, a rotary drive transmitting mechanism used for rotatively driving the take-up reel when the supply reel rotates in an unwinding movement and including a clutch mechanism for providing a driving transmission ratio of the rotary drive transmitting mechanism which is adapted to respective unwinding and winding-up conditions of the reels, wherein the clutch mechanism comprises a friction wheel element which yields in a radial direction which is arranged coaxially with an axis of said take-up reel or said supply reel, the friction wheel element abutting via a peripheral surface thereof on a peripheral surface section of a counterwheel element so as to provide a friction force-transmitting area of contact, the device including a return stop device which comprises an engagement section which is provided in the housing and which is adapted to engage with a sawtooth section formed on an end face of a shaft section of the take-up reel which faces toward a lateral surface of the housing.

2. The device of claim 1, wherein the friction wheel element is arranged coaxially with the take-up reel.

3. The device of claim 1, wherein the counterwheel element is arranged coaxially with the supply reel.

4. The device of claim 1, wherein the external diameter of the friction wheel element corresponds essentially to the diameter of a tape core provided for receiving thereon the carrier strip.

5. The device of claim 1, wherein the external radius of the friction wheel element is smaller than the radius of curvature of the surface section of the counterwheel element abutting on the friction wheel element.

6. The device of claim 1, wherein the friction wheel element is an annular member which when cut by a plane including its center axis has a rectangular crosssection.

7. The device of claim 1, wherein an axial width of the friction wheel element is smaller than a thickness of the friction wheel element measured in a radial direction thereof.

8. The device of claim 1, wherein the friction wheel element is formed by an annular member, and a cross-sectional height of said annular member measured in a radial direction corresponds substantially to half an internal diameter of the annular member.

9. The device of claim 1, wherein undergoing elastic expansion, the friction wheel element is attached to a shaft section of the take-up reel or the counter-wheel.

10. The device of claim 1, wherein the friction wheel element has an internal diameter which is larger than the external diameter of a shaft section provided for receiving thereon the friction wheel element.

11. The device of claim 1, wherein the friction wheel element is an O-ring.

12. The device of claim 1, wherein the friction wheel element is produced from an elastic material having a high coefficient of surface friction.

13. The device of claim 1, wherein the friction wheel element is produced from a foamed material.

14. The device of claim 1, wherein the take-up reel comprises a shaft section for receiving thereon the friction wheel element and a shaft section for receiving thereon a tape core.

15. The device of claim 1, wherein a manually operable tensioning wheel is provided on the take-up reel between a shaft section receiving thereon a tape core and a shaft section receiving thereon the friction wheel element.

16. The device of claim 1, wherein the supply reel includes the counterwheel element and a shaft section for receiving thereon a tape core.

17. The device of claim 16, wherein the counterwheel element has a diameter which is larger than the tape core diameter of the supply reel.

18. The device of claim 1, wherein a tensioning wheel is provided on the take-up reel between a shaft section receiving thereon a tape core and a shaft section receiving thereon the friction wheel element adjacent an area of contact between the friction wheel element and the counter-wheel element.

19. The device of claim 1, wherein a shaft of the take-up reel is arranged in a housing area located adjacent an applicator device.

20. The device of claim 17, wherein the distance between the shaft of the supply reel and the applicator device is larger than the distance between the shaft of the take-up reel and the applicator device.

21. The device of claim 1, wherein the carrier strip is unwound from the supply reel in an area located between the supply reel and the take-up reel, and the carrier strip is supplied to the take-up reel in an area which is located diametrically opposite an unwinding area of the supply reel relative to the shaft of the take-up reel.

22. The device of claim 1, wherein the counterwheel element has a diameter which is larger than an external diameter of a supply tape roll.

23. The device of claim 1, wherein the counterwheel element has a profile.

24. The device of claim 1, wherein the counterwheel element has a convex or a concave outer surface.

25. The device of claim 1, wherein the friction wheel element is attached to the shaft section provided with the sawtooth section.

26. The device of claim 1, wherein the take-up reel is adapted to be axially moved relative to the housing.

* * * * *